US011104495B1

(12) United States Patent
Abbisso, Jr.

(10) Patent No.: US 11,104,495 B1
(45) Date of Patent: Aug. 31, 2021

(54) COMPOUND HAWK ASSEMBLED BY USER USING A COMPOUND CONTAINER

(71) Applicant: Leonard J. Abbisso, Jr., Dedham, MA (US)

(72) Inventor: Leonard J. Abbisso, Jr., Dedham, MA (US)

( * ) Notice: Subject to any disclaimer, the term of this patent is extended or adjusted under 35 U.S.C. 154(b) by 657 days.

(21) Appl. No.: 14/820,644

(22) Filed: Aug. 7, 2015

(51) Int. Cl.
*B65D 25/28* (2006.01)
*B65D 51/24* (2006.01)
*B65D 43/02* (2006.01)

(52) U.S. Cl.
CPC ..... *B65D 51/24* (2013.01); *B65D 25/28* (2013.01); *B65D 43/0204* (2013.01)

(58) Field of Classification Search
CPC .... A04F 21/06; A04F 21/165; A04F 21/1655; A04F 21/16; A04F 21/1657; E04F 21/06; E04F 21/165; E04F 21/1655; E04F 21/16; E04F 21/1657; B65D 51/24; B65D 43/0204
USPC ..... 220/212.5, 212, 3.3, 480; 248/429, 248/229.12, 309.1, 316.4
See application file for complete search history.

(56) References Cited

U.S. PATENT DOCUMENTS 963,143 A * 7/1910 Hansen et al. ..... E04F 21/06 294/3.5
2,821,078 A * 1/1958 Steward ..... E04F 21/06 222/409
3,035,733 A * 5/1962 Knapp ..... A47J 36/06 220/212.5
3,790,201 A * 2/1974 Morsilli ..... E04F 21/06 15/257.06
4,357,772 A * 11/1982 Amick ..... G09F 7/18 248/159
4,753,471 A * 6/1988 Gringer ..... E04F 21/06 294/3.5
4,880,192 A * 11/1989 Vom Braucke ..... A47L 13/512 211/66
5,186,507 A * 2/1993 Neidfeld ..... E04F 21/06 294/146
5,406,671 A 4/1995 Green
5,603,428 A * 2/1997 Breckwoldt ..... E04G 21/005 220/755
5,803,297 A * 9/1998 Vasquez ..... B65D 43/161 220/212.5
7,497,327 B2 3/2009 Martinez et al.
7,543,350 B2 6/2009 Cheney et al.
8,561,835 B2 * 10/2013 Hansen ..... A47J 36/06 220/298

(Continued)

*Primary Examiner* — Robert Poon
(74) *Attorney, Agent, or Firm* — Stan Collier, Esq

(57) ABSTRACT

The bucket hawk provides a readily usable, inexpensive and easily assembled device for transporting and holding dry-wall joint compound that has been removed from the plastic container that may range in size from a container having several pounds to tens of pounds of compound therein. The bucket hawk provides a removable handle that is attached to the bucket lid. The lid is removed and the handle attached to the underside of the lid, preferably. The compound is removed from the bucket and placed on the hawk/lid. After use, the handle may be removed and the lid placed back on the bucket/container. If a sufficient amount of the compound has been removed, the handle may remain on the underside of the lid when replaced on the container. The handle may be placed on the underside or topside of the lid.

1 Claim, 5 Drawing Sheets

(56) References Cited

U.S. PATENT DOCUMENTS

2006/0265829 A1* 11/2006 Gilli ..... E04F 21/06
15/235.4
2012/0132652 A1* 5/2012 Barber ..... B65D 11/105
220/212.5

* cited by examiner

COMPOUND HAWK ASSEMBLED BY USER USING A COMPOUND CONTAINER

CROSS REFERENCES TO RELATED APPLICATIONS

NA

REFERENCE TO FEDERALLY SPONSORED RESEARCH OR DEVELOPMENT

NA

REFERENCE TO JOINT RESEARCH AGREEMENTS

NA

REFERENCE TO SEQUENCE LISTING

NA

BACKGROUND OF THE INVENTION

Field of the Invention

The present invention relates to building tools, and, in general, relates to tools used in finishing walls, and, in particular, relates to tools for holding joint compound and other pliable compounds before application.

Description of the Prior Art

The use of a traditional hawk is well known for transporting and holding mud or compound or mastic before use in commercial settings. The compound is removed from a container and placed upon the hawk platform that is typically rectangular in shape. The platform is usually made of metal such as aluminum. A trowel is used to remove a sufficient amount of the compound to be used. The square platform is also used to remove the compound from the trowel by wiping the blade on the edge. The platform is attached to a handle by one or more screws and usually shaped as a cylindrical rod. After use, the platform is cleaned by washing the surface of the platform.

Numerous hawks are known to one skilled in the art as made or sold by Allway, Faithfull, MarshailTown, Kobalt, Product No. 4974; Kraft ToolS, Goldblatt Tools, Hyde Tools, Mintcraft Tools, Tuff Stuff Tools, Wal-Board Tools, etc. U.S. Patent Application Publication 2005/0194392 discloses a replacement lid for a bucket for holding tools such as a hawk. U.S. Patent Application Publication 2005/0204691 discloses a belt device for holding a hawk. U.S. Pat. No. 5,406,671 discloses a device for replacing a traditional hawk and trowel for applying joint compound to a wall. All references are incorporated by reference as to their teachings.

Accordingly, there is a need for device for carrying and holding compounds that is readily available to the consumer in a non-commercial setting or even a professional.

SUMMARY OF THE INVENTION

A bucket hawk of the present invention should be immediately available, inexpensive and easily assembled to be a desirable product for use by a home consumer and even a professional as needed.

The bucket hawk is used for transporting and holding drywall joint compound, in particular, that has been removed from a plastic container that may range in size from a container having several pounds to tens of pounds of compound therein, such as a 5 gallon container. The bucket hawk of the present invention provides an easily removable handle that is attached to the bucket lid. The lid is removed and the handle attached to the underside of the lid, preferrably. The compound is removed from the bucket and placed on the hawk/lid. After use, the handle may be removed and the lid placed back on the bucket/container. If a sufficient amount of the compound has been, removed, the handle may remain on the underside of the lid when replaced on the container. The handle may be placed on the underside or bottom or topside or top of the lid.

One object of the present invention is to provide a hawk for use by a consumer that is easily assembled and inexpensive.

It is another object of the present invention to provide a hawk that is adapted for use with a compound bucket lid.

It is further object of the present invention to provide a hawk that may be stored with the bucket until further use.

It is still a further object of the present invention to provide a hawk wherein the handle is easily installed and removed.

It is yet a further object of the present invention to provide a hawk that is comfortable for use by having a handle that is formed in an ergonomic manner.

These and other objects, features, and advantages of the present invention will become more readily apparent from the attached drawings and the detailed description of the preferred embodiments, which follow.

BRIEF DESCRIPTION OF THE DRAWINGS

Like reference numerals refer to like parts throughout the several views of the drawings.

DETAILED DESCRIPTION OF THE PREFERRED EMBODIMENTS

The present invention provides a bucket hawk that is readily available and an inexpensive tool to the consumer or even a professional for repairing or finishing wall surfaces using drywall compound.

In general, the bucket hawk is used for transporting and holding drywall compound that has been removed from a plastic container that may range in size from a container having several pounds to tens of pounds of compound therein, such as a 5 gallon container. A removable handle is attached to the bucket lid as described herein. The lid is removed and the handle attached to the bottom side of the lid, preferably. The compound is removed from the bucket and placed on the hawk/lid. After use, the handle may be removed and the lid placed back on the bucket/container. Thus the consumer/professional has an available hawk with the removable handle. The manufacturer can thus provide this handle as an added benefit with their containers. If a sufficient amount of the compound has been removed, the handle may remain on the underside of the lid when replaced on the container until the container is thrown away.

Figure 1:
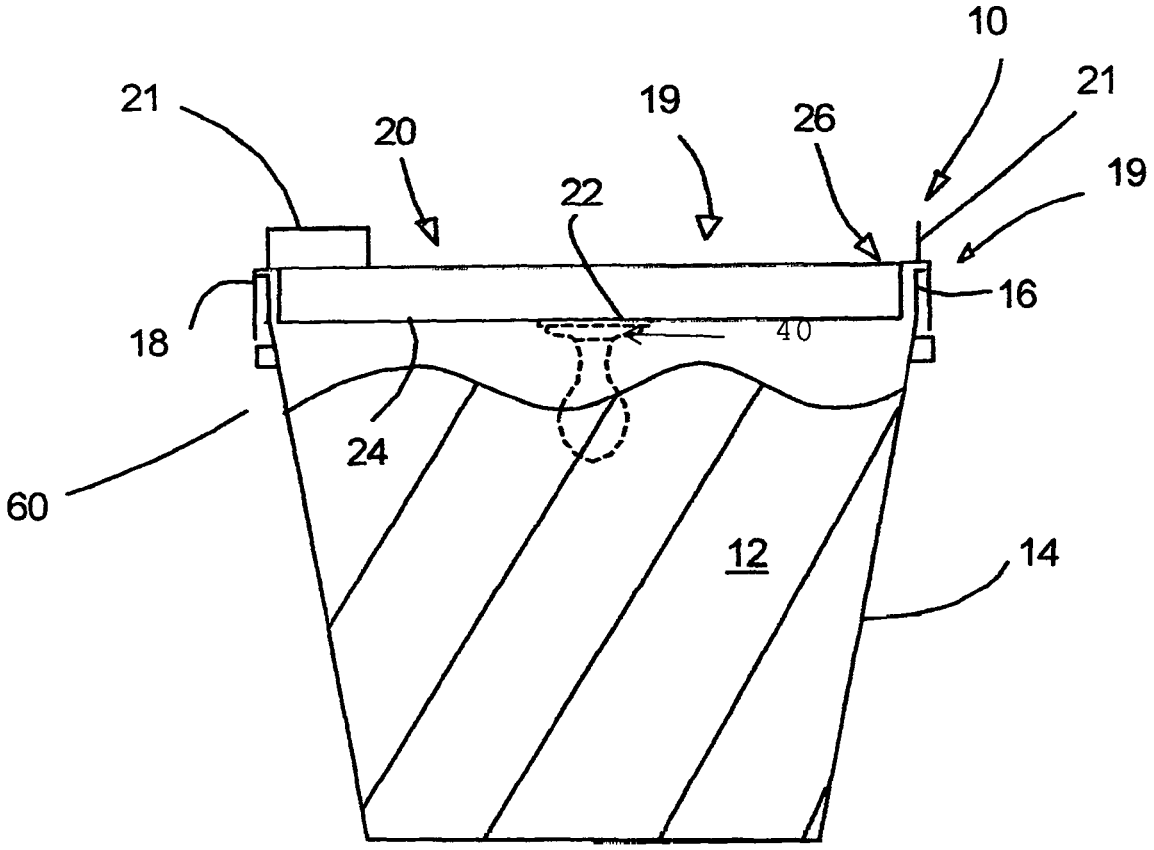
FIG. 1 is an schematic illustration of a compound container with a handle in outline attached to the bottom of the bucket lid of the present invention.
Figure 6:
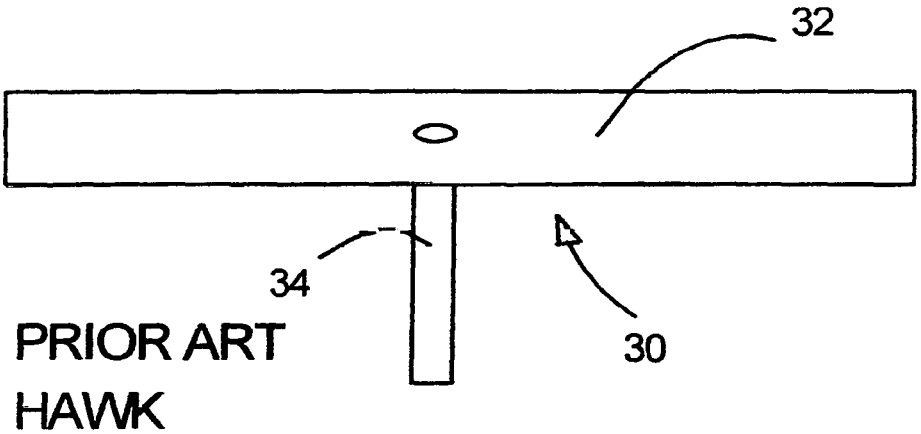
FIG. 6 is the prior art hawk.

Referring to the figures, FIG. 1 illustrates schematically a container 10 of drywall compound 12 with a bucket 14 that is made of plastic. A top edge/lip 16 of the bucket 14 is designed to be pressed into a slot/channel 18 in an enhanced edge 19 on a lid 20. The lid 20 has a flat top side 22 and a flat bottom side 24 with a surrounding perimeter structure 26 or enhanced edge 19 having the slot/channel 18 therein. As seen in the drawings, the lid 20 has the enhanced edge 19 that only serves as the location of the slot/channel 18, but serves also to keep the mud, compound, or mastic located on the top side 22 when placed there like a dam. Traditionally the consumer carries the bucket hawk 60 around and thus the enhanced edge 19 prevents the compound from sliding off. The handle is shown in outline in FIG. 1 attached to the bottom side 24. An enhanced lip 21 may also be added to the enhanced edge 19 to allow the user to clean the trowel thereon although the enhanced edge 19 can be used for that also. The enhanced edge/lip 21 may be a straight wall or curved along the top edge partially and approximately ¼ inch or so in height. The bucket 14 ranges in size from a three pound container of pliable compound Lo one having 5 gallons of pliable compound therein. The lid 20 has a diameter from about 5 inches to about 18 inches. Shown thereunder in FIG. 6 is a conventional hawk 30 having a square platform 32 bolted onto a handle 34. The platform 32 is approximately one foot square and the conventional hawk 30 must be bought separately and stored separately due to its size.

It is thus inconvenient for the home consumer who desires to repair nail holes, dents, door knob holes, or other damage to sheet rock boards to apply the dry wall compound because the compound must be removed directly from the container by trowel and then applied to the surface. The home consumer does not usually purchase a conventional hawk believing that the repair can be done without such an extra tool. It is thus asserted that having a bucket hawk as provided for in the present invention will allow the consumer to have an inexpensive, readily available, and easily assembled hawk even for the smallest of projects.

Figure 2:
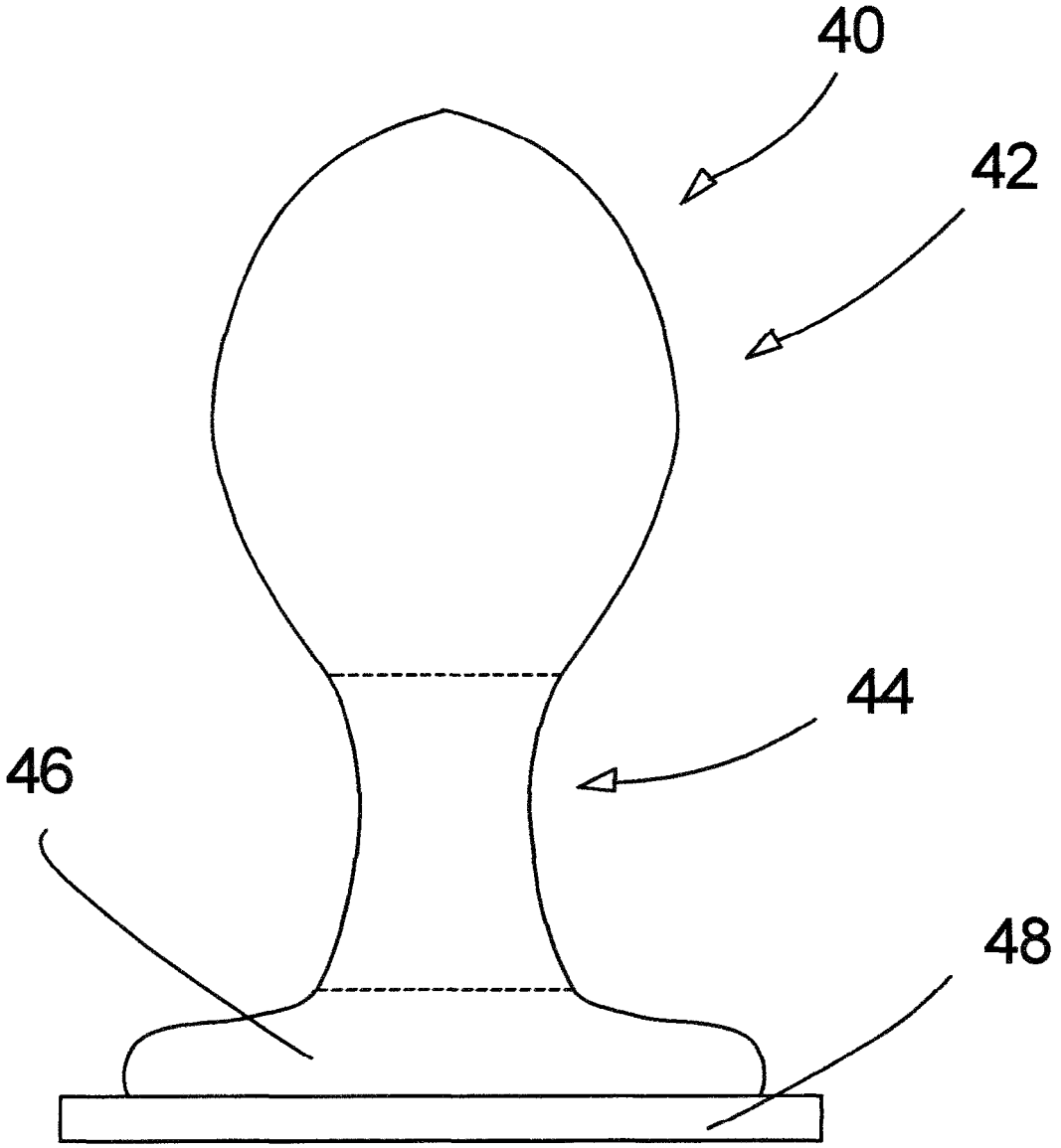
FIG. 2 is a side view of an ergonomic handle for use by either a right handed or left handed person

FIG. 2 illustrates a handle 40 that may range in sizes according to the diameter of the bucket lid 20. The handle 40 will be ergonomically shaped to insure ease of handling. The handle 40 will include a palm shaped section 42 with a middle section 44 that the index and thumb fingers grasp, and further a supporting section 46 will allow the weight of the lid and compound thereon to rest comfortably on the upper surfaces of the index and thumb fingers. The handle 40 will be for either a right or left handed person. A base section 48 will have the handle 40 attached thereto and have a flat top 50 for attachment purposes as will be described herein. The handle 40 and base section 48 will be composed of plastic materials. Further the handle 40 may be partially hollow to allow flexing and to reduce overall weight.

Figure 3:
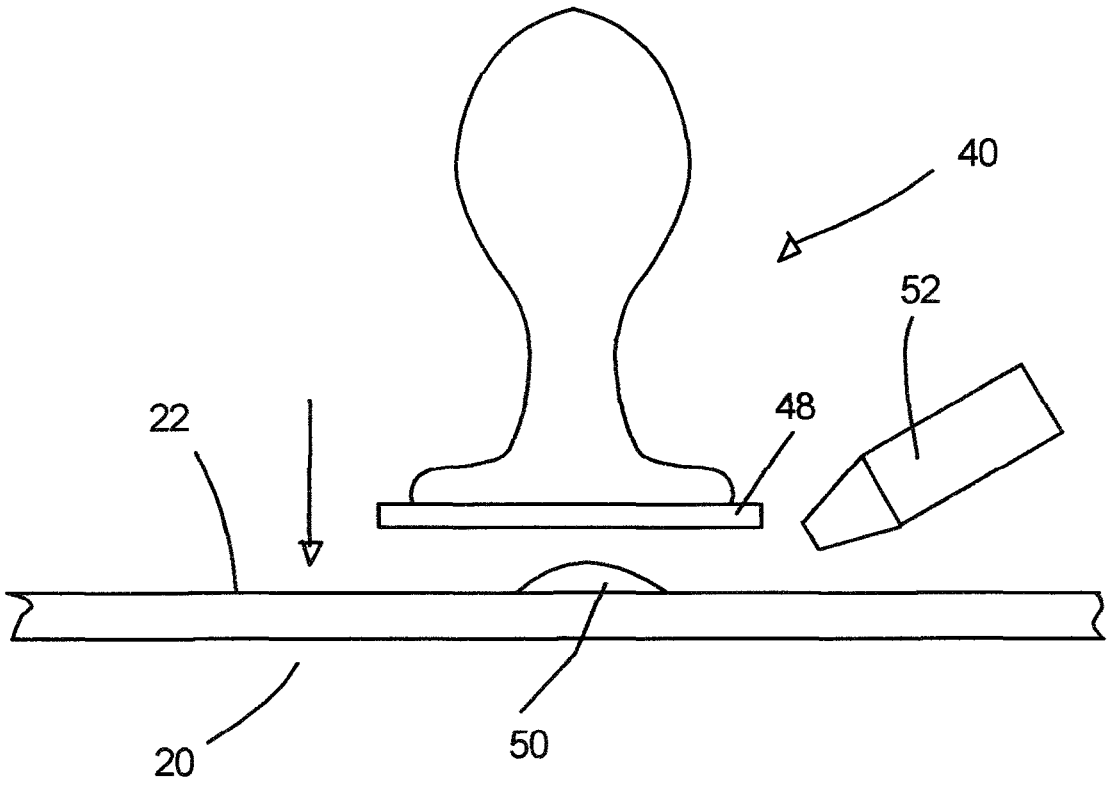
FIG. 3 is a side view of a handle mounted on a base and being attached to a lid surface by use of cement, as one embodiment.

As noted above, the lid 20 may be small and thus not allow complex structures thereon to hold the handle 40. In this embodiment, the handle 40 and base section 48 are attached directly onto the top side 22 of the lid 20 as shown in FIG. 3. It is thus asserted that the simplest means for mounting of the handle 40 and base 48 is by cementing where a pocket 52 of cement is opened and the cement 50 applied to the location where the base section 48 will be attached. The bucket lid 20 has two sides, with at least one side being capable of having the mounting means attached thereon. The handle base is attached to the top side 22 if a volume of said bucket is not sufficient to have the handle therein or the lid is too small otherwise. In this embodiment, the handle 40 is permanently attached to the lid 20 and thus future use of the container will present no issues.

In this embodiment, the lid 20 with the handle 40 thereon will be removed for use. The compound removed therefrom by trowel. After use, the lid 20 can be replaced.

Figure 4A:
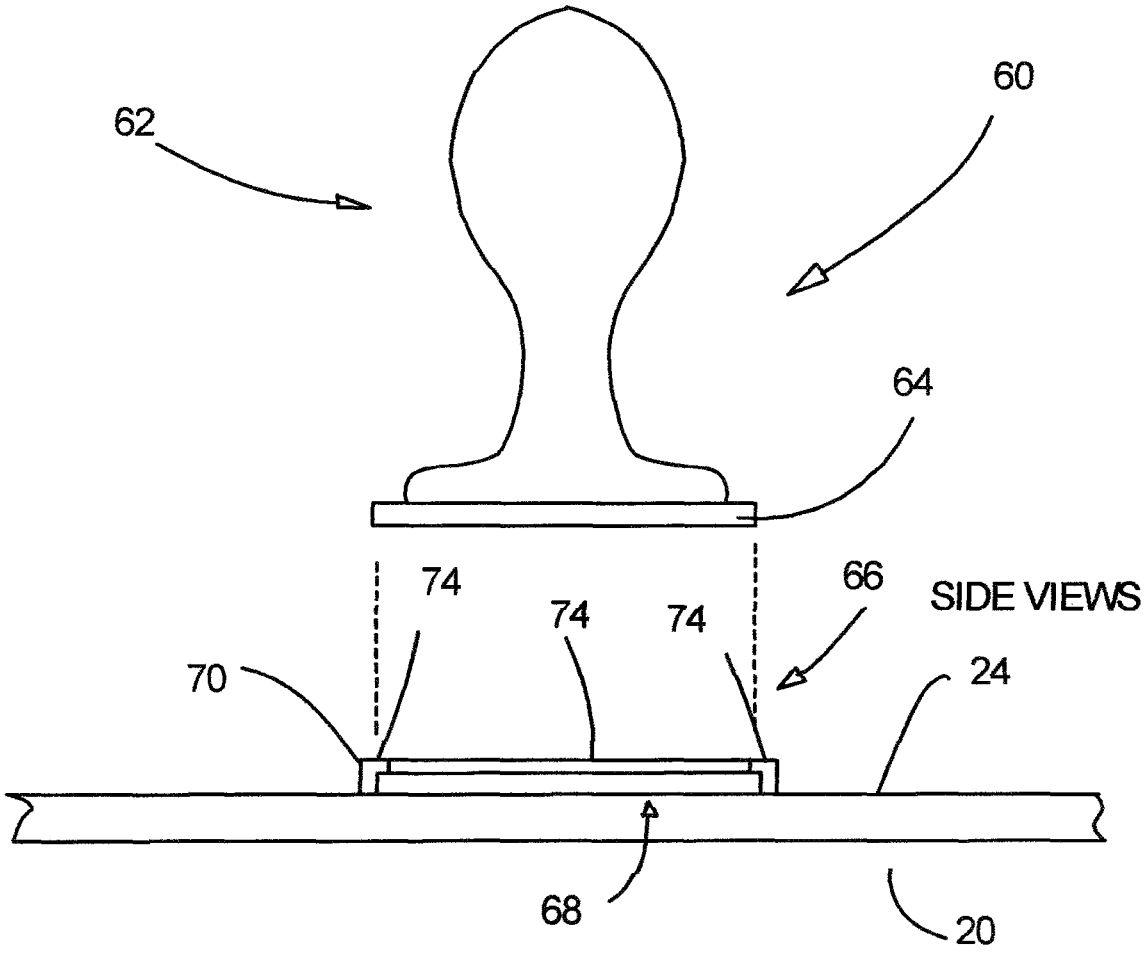
FIGS. 4A and 4B illustrate the handle being removably attached to a slotted housing on the container/bucket lid.
Figure 4B:
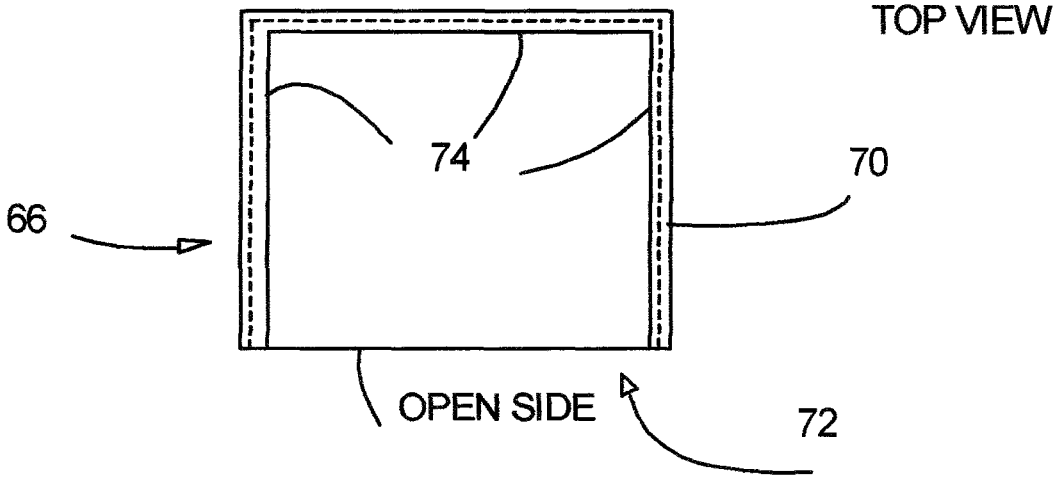
Figure 5A:
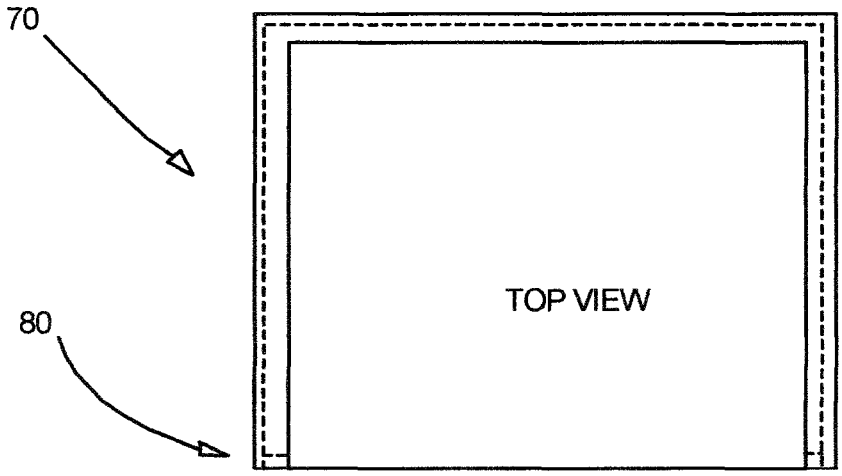
FIGS. 5A, 5B, and 5C illustrate various detent devices for removably holding the handle within the slotted housing.

In another embodiment the bucket hawk 60 shown in FIGS. 4A and 4B and FIGS. 5A. 5B and 5C has a removable handle 62 with a flat base section 64 attached to the bottom of the handle 62. A mounting means being the flat base section 64 and a housing 66 is integrally attached to a bottom side 24 of the bucket lid 20 in a central position 68. The housing 66 provides a three sided slotted frame 70 for the insertion of the base 64 therein. FIG. 4B is a top view of the frame 70. An open side 72 allows the base 64 to be slide into the housing 70 and under the lips 74 on three sides. Due to the size of the handle 62 and the housing 70, these are normally placed on the bottom side 24 of the lid 20. The handle 62 may have to be removed when the compound is blocking the handle when the lid 20 is closed on the bucket. To provide greater options to the manufacturer and consumer, the housing 70 may also be attached to a base like that above and then the base with the housing 70 is attached to the lid as desired.

Figure 5B:
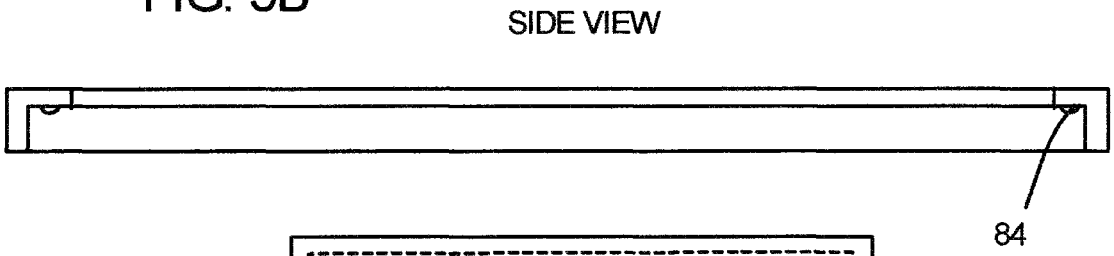
Figure 5C:
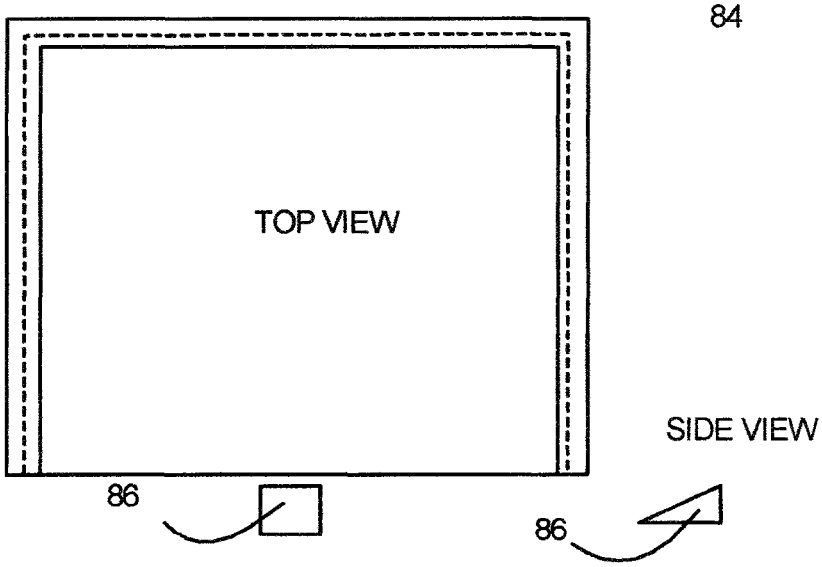

In order to insure that the base section 64 remains in the housing 70, a detent device 80 for temporarily holding the base therein may be required. FIG. 5A shows a small wall 82 attached to the underside of the lips 74 near the entrance. FIG. 5B shows small bumps 84 on the underside of the lips 74 near the entrance. FIG. 5C shows a small slanted wall 86 in front of the open side 72. Considering that the lid is plastic and the housing is plastic, each detent will deform/move upon the base being pushed into the housing 70 to hold the base therein until it is forced outward. Clearly other devices are possible.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A bucket hawk, said bucket hawk being sold attached to a drywall joint compound bucket being a container that is attachable to said bucket hawk for an air tight seal to protect the joint compound therein, said bucket hawk comprising:

a bucket lid, said bucket lid being capable of being snap fitted to a bucket lip of said bucket, said bucket lid composed of plastic, said bucket lid having two sides and further being one piece and with no moving parts thereon, said two sides being a top side and a bottom side, said bucket lid further having a slot/channel thereabout so that it may be snap fitted onto a lip of said bucket to form an air tight seal;

a bucket hawk handle;

a base, said bucket hawk handle being fixedly attached to said base; and means for removably holding said base to said bucket lid upon said top side or said bottom side of said bucket lid;

wherein said bucket, said bucket lid, said bucket hawk handle, said base and said means for removably holding are sold as a single product such that the bucket and said bucket lid are attachable together at sale with a drywall joint compound therein.

* * * * *